US006494742B1

(12) United States Patent
Hu

(10) Patent No.: US 6,494,742 B1
(45) Date of Patent: Dec. 17, 2002

(54) SHIELDED ELECTRICAL CONNECTOR HAVING REDUCED HEIGHT ABOVE CIRCUIT BOARD

(75) Inventor: Xuxiao Hu, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/035,853

(22) Filed: Dec. 24, 2001

(51) Int. Cl.[7] ..... H01R 13/648

(52) U.S. Cl. ..... 439/607; 439/79; 439/545; 439/547; 439/554

(58) Field of Search ..... 439/607, 79, 545, 439/547, 554, 609, 610, 717, 939

(56) References Cited

U.S. PATENT DOCUMENTS 6,095,865 A * 8/2000 Wu ..... 439/607
6,109,966 A * 8/2000 Chiou ..... 439/607

* cited by examiner

*Primary Examiner*—Tho D. Ta
(74) *Attorney, Agent, or Firm*—Wei Te Chung

(57) ABSTRACT

An electrical connector (1) for mounting to a circuit board (5) includes an insulative housing (2), a number of electrical terminals (3) and a conductive outer shield (4). The insulative housing has a mating face (20), a mounting face (22) opposite to the mating face and a number of passageways (24) extending through the mating face and the mounting face. The electrical terminals are received in the passageways. The conductive outer shield encloses the insulative housing and has a pair of grounding tabs (46) partly inserted into the circuit board and partly cooperating with the insulative housing to be supported by the circuit board.

2 Claims, 5 Drawing Sheets

SHIELDED ELECTRICAL CONNECTOR HAVING REDUCED HEIGHT ABOVE CIRCUIT BOARD

BACKGROUND OF THE INVENTION

1. Field of the Invention

The present invention relates to an electrical connector, and particularly to an electrical connector which has a reduced height above a circuit board.

2. Description of the Related Art

Personal computers, especially notebook computers, are becoming increasingly compact nowadays, so the entire space within a personal computer enclosure must be efficiently used, which becomes one of the most important design considerations for electrical connectors mounted on a circuit board in the personal computer enclosure.

Miniature DIN (mini DIN) connectors are often provided for connecting mainframes to keyboards or mice of the personal computers. When the mini DIN connectors are adapted to be used for notebook computers, insulative housings and conductive outer shields of the mini DIN connectors are always in cylindrical configurations for compactness considerations. In addition, the cylindrical mini DIN connector is often mounted to a circuit board with a front lower portion thereof located below a bottom face of the circuit board for further reducing the height thereof above a top face of the circuit board.

The cylindrical mini DIN connector is supported by the circuit board on a rear portion thereof and a front portion of the cylindrical mini DIN connector is often at the risk of downwardly moving with respect to the circuit board after long-term insertion or plugging of a complementary electrical connector, since there is no retention between the front portion of the cylindrical mini DIN connector and the circuit board, which puts the electrical connection between electrical terminals of the cylindrical mini DIN connector and the circuit board in the danger of breaking out.

Some methods have already been proposed to improve the retention between the cylindrical mini DIN connector and the circuit board, including enlarging an engaging area of the insulative housing so as to be secured on the circuit board. However, enlarging the engaging area unavoidably enlarges also the volume of the whole cylindrical mini DIN connector and increases the space occupied by the cylindrical mini DIN connector on the circuit board.

Therefore, an improved electrical connector is desired to overcome the above-mentioned disadvantages.

SUMMARY OF THE INVENTION

A major object of the present invention is to provide an electrical connector which has a reduced height above a circuit board and which is reliably mounted on the circuit board.

An electrical connector in accordance with the present invention comprises an insulative housing, a plurality of electrical terminals and a conductive outer shield. The insulative housing is generally cylindrical and comprises a generally circular mating face, a generally circular mounting face opposite to the mating face and a plurality of passageways extending through the mating and the mounting faces. The electrical terminals are received in the passageways. The conductive outer shield encloses the insulative housing and comprises a pair of grounding tabs cooperating with the insulative housing to support the electrical connector on a circuit board while the electrical connector is partly located below the circuit board.

Other objects, advantages and novel features of the invention will become more apparent from the following detailed description of the present embodiment when taken in conjunction with the accompanying drawings.

DETAILED DESCRIPTION OF THE INVENTION

Figure 1:
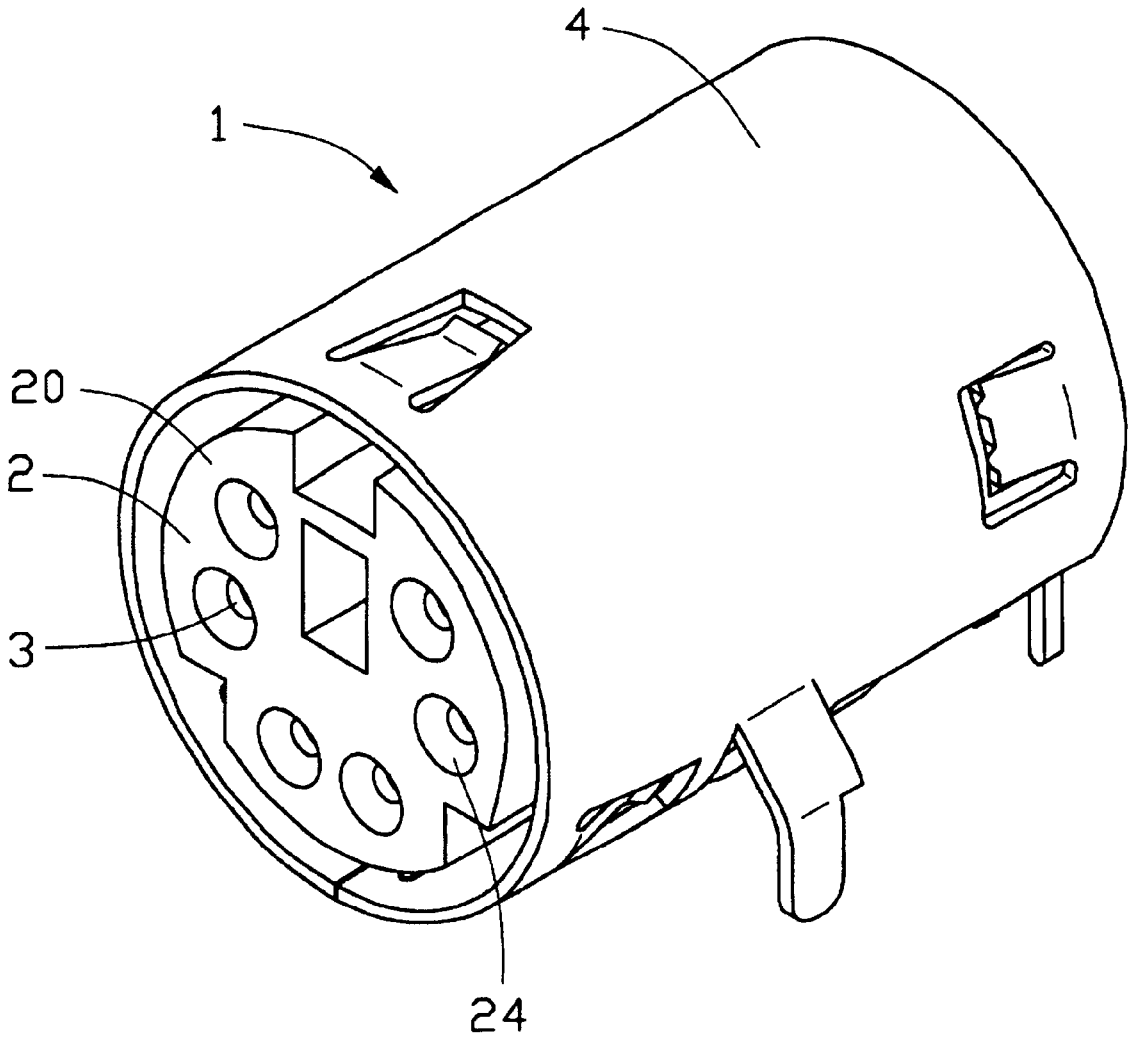
FIG. 1 is a perspective view of an electrical connector in accordance with the present invention.

Referring to FIG. 1, an electrical connector 1 in accordance with the present invention comprises an insulative housing 2, a plurality of electrical terminals 3 and a conductive outer shield 4.

Figure 2:
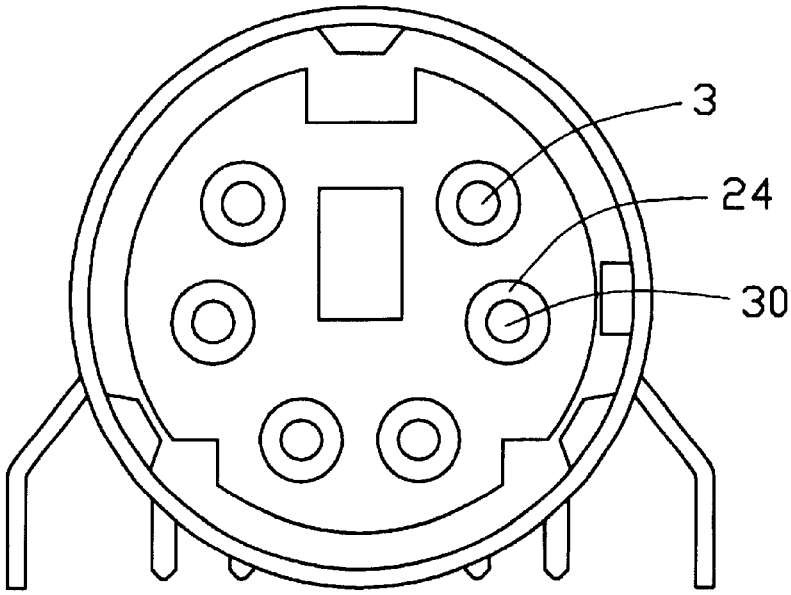
FIG. 2 is a front view of the electrical connector of FIG. 1.
Figure 3:
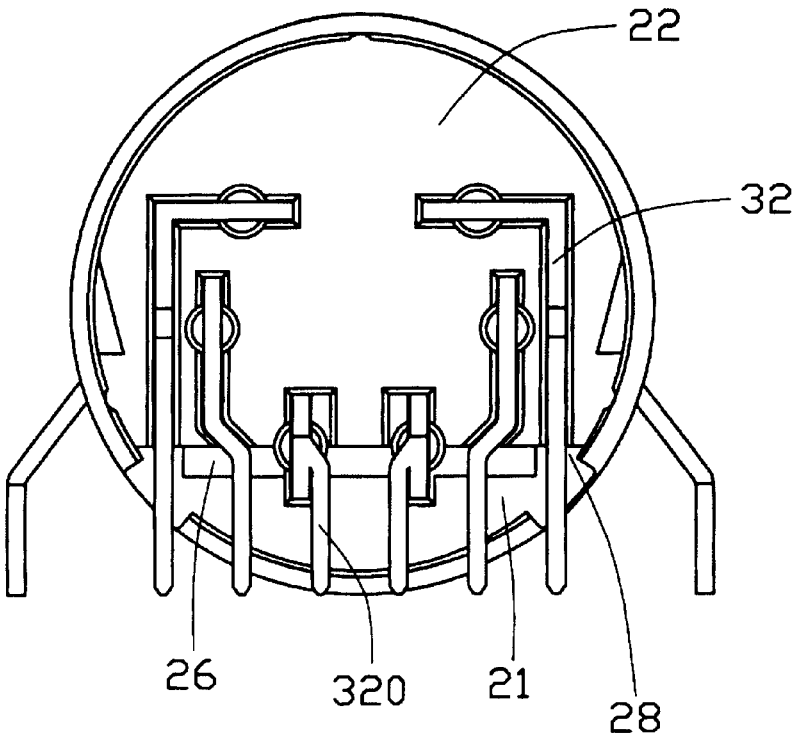
FIG. 3 is a rear view of the electrical connector of FIG. 1.

Referring also to FIGS. 2 and 3, the insulative housing 2 is generally cylindrical and defines a generally circular mating face 20, a generally circular mounting face 22 opposite to the mating face 20 and a plurality of passageways 24 extending through the mating face 20 and the mounting face 22. The insulative housing 2 is formed with a step portion 26 in a rear portion thereof and defines a plurality of vertically extending channels 28, and a cutout 21 below the step portion 26. The channels 28 correspond in number to the electrical terminals 3 and open to the mounting face 22.

Each electrical terminal 3 comprises a contact portion 30 accommodated in a corresponding passageway 24 and exposed to the mating face 20 and a mounting portion 32 extending beyond the passageway 24 to partially engage with the mounting face 22 of the insulative housing 2. The mounting portions 32 are so configured that lower sections 320 thereof extend through corresponding channels 28 to be arranged in one row and to be spaced from the mounting face 22 by the cutout 21.

Figure 4:
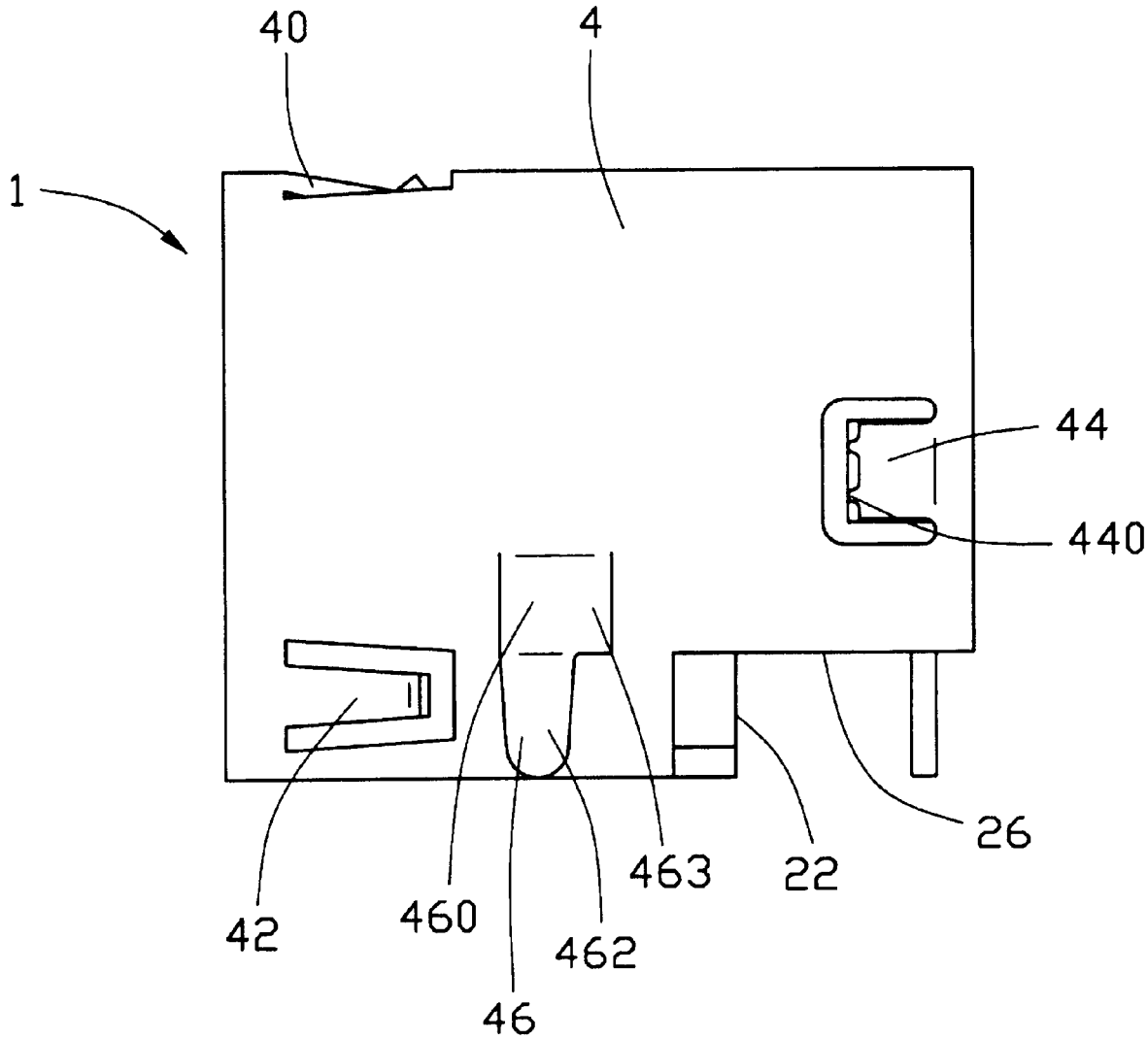
FIG. 4 is a side elevational view of the electrical connector of FIG. 1.
Figure 5:
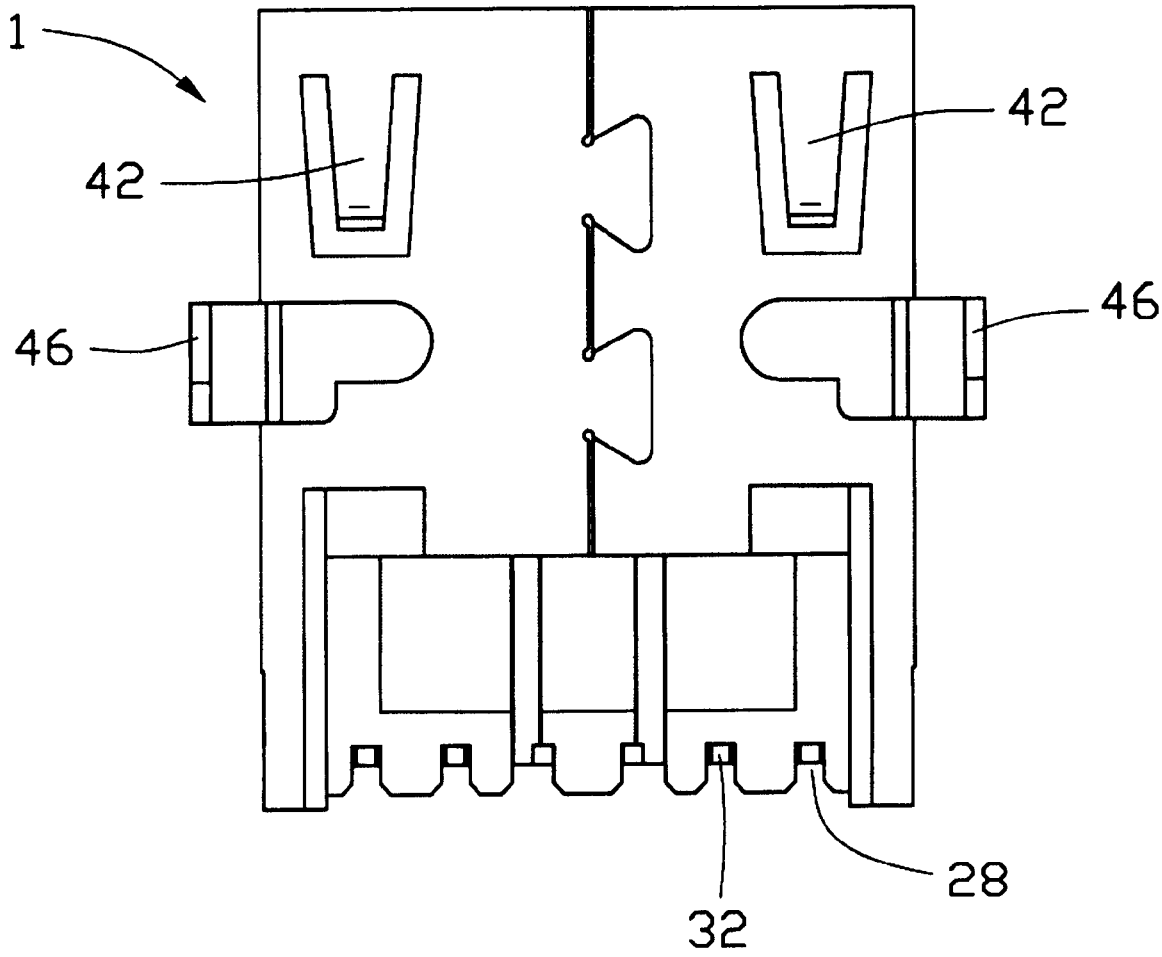
FIG. 5 is a bottom plan view of the electrical connector of FIG. 1.

Referring also to FIGS. 4 and 5, the conductive outer shield 4 encloses the insulative housing 2 in ordinary ways known to persons skilled in the pertinent art and corresponds in shape to the insulative housing 2 to be generally cylindrical. The conductive outer shield 4 comprises a rearwardly extending top tab 40 in a top front portion thereof, a pair of rearwardly extending opposite lower tabs 42 in a lower front portion thereof, a pair of forwardly extending opposite rear tabs 44 (only one shown) in a rear portion thereof and above the cutout 21, and a pair of opposite grounding tabs 46 located at a lower section thereof and between the lower tabs 42 and the mounting face 22. The top and the lower tabs 40, 42 are so configured as to engage with a conductive outer shield of a mating electrical connector (not shown) complementary to the electrical connector 1. Each rear tab 44 is formed with a plurality of barbs 440 engaging with the insulative housing 2 to provide a mechanical retention therebetween. Each grounding tab 46 comprises an upper portion 460 extending outwardly and downwardly from the lower front portion of the conductive outer shield 4 and a lower portion 462 extending vertically and downwardly from the upper portion 460. The upper portion 460 is wider than the lower portion 462 so that a rear section 463 thereof extends rearwardly beyond the rear edge of the lower portion 462.

Figure 6:
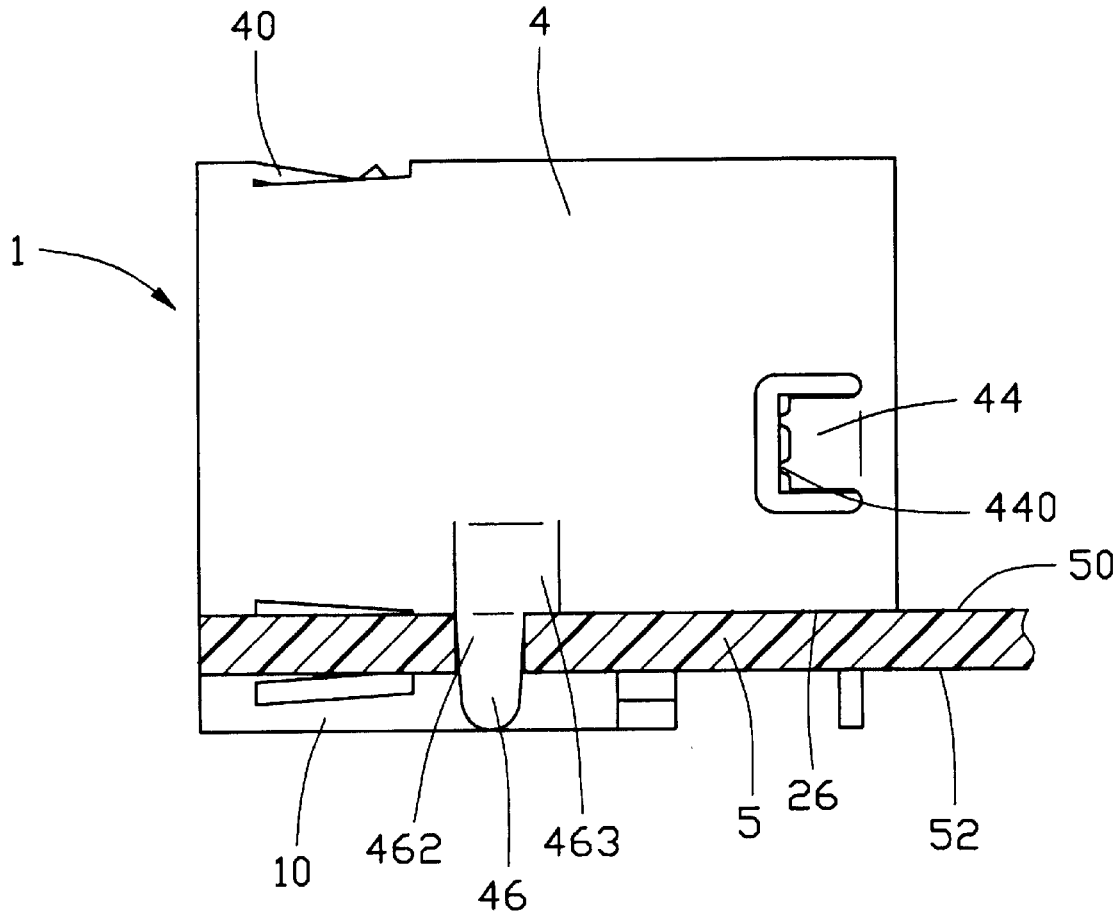
FIG. 6 is a view similar to FIG. 4 but showing the electrical connector has been mounted to a circuit board.

Referring to FIG. 6, when the electrical connector 1 is mounted to a circuit board 5, the lower portions 462 of the grounding tabs 46 extend through the circuit board 5. The step portion 26 of the insulative housing 2 and the rear sections 463 of the upper portions 460 of the grounding tabs 46 of the conductive outer shield 4 abut against a top face 50 of the circuit board 5 to support the electrical connector 1 on the circuit board 5 while a front lower portion 10 of the electrical connector 1 is, as known to one of skilled in the pertinent art, accommodated in a cutout (not shown) in a front portion of the circuit board 5 with a bottom thereof located below a bottom face 52 of the circuit board 5.

The electrical connector 1 is supported by the circuit board 5 on both the step portion 26 of the insulative housing 2 and the rear sections 463 of the grounding tabs 46 of the conductive outer shield 4, so the retention between the electrical connector 1 and the circuit board 5 is improved and the downwardly movement of a front portion of the electrical connector 1 with respect to the circuit board 5, after long-term use, is reduced.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for mounting to a circuit board having a top face and a bottom face opposite to the top face, comprising:

a cylindrical insulative housing comprising a circular mating face, a circular mounting face opposite to the circular mating face, a plurality of passageways extending through the circular mating face and the circular mounting face, and a step portion in a rear portion thereof, said step portion supported on the top face of the circuit board, the cylindrical insulative housing being partly located below a bottom face of the circuit board;

a plurality of electrical terminals being received in the passageways of the cylindrical insulative housing; and a conductive outer shield enclosing the cylindrical insulative housing and comprising a grounding tab, the grounding tab comprising a lower portion extending through the circuit board and an upper portion supported by the top face of the circuit board;

wherein the upper portion of the grounding tab extends outwardly and downwardly from a lower portion of the conductive outer shield and the lower portion of the grounding tab extends vertically and downwardly from the upper portion;

wherein the upper portion is wider than the lower portion and has a rear section extending rearwardly beyond the lower portion and supported by the top face of the circuit board;

wherein the cylindrical insulative housing defines a plurality of vertically extending channels and each electrical terminal comprises a mounting portion having a lower section extending through the channel;

wherein the cylindrical insulative housing is formed with a cutout below the step portion and the lower sections of the mounting portions of the electrical terminals are spaced from the mounting face by the cutout.

2. The electrical connector as claimed in claim 1, wherein the conductive outer shield comprises a pair of grounding tabs.

* * * * *